US005260687A

United States Patent [19]

Yamauchi et al.

[11] Patent Number: 5,260,687

[45] Date of Patent: Nov. 9, 1993

[54] COMBINED METHOD OF DETERMINING FIRES

[75] Inventors: Yukio Yamauchi, Atsugi; Shigeru Ohtani, Hiratsuka, both of Japan

[73] Assignee: Hochiki Kabushiki Kaisha, Tokyo, Japan

[21] Appl. No.: 816,172

[22] Filed: Jan. 2, 1992

[30] Foreign Application Priority Data

Jan. 18, 1991 [JP] Japan ..... 3-4651

[51] Int. Cl.[5] ..... G08B 19/00

[52] U.S. Cl. ..... 340/522; 340/511; 340/521; 340/588

[58] Field of Search ..... 340/522, 521, 510, 511, 340/506, 588, 589

[56] References Cited

U.S. PATENT DOCUMENTS

| | | | |
|---|---|---|---|
| 4,459,583 | 7/1984 | van der Walt et al. | 340/511 |
| 4,517,554 | 5/1985 | Moser et al. | 340/511 |
| 4,546,344 | 10/1985 | Guscott et al. | 340/511 |
| 5,105,371 | 4/1992 | Shaw et al. | 340/511 |
| 5,128,653 | 7/1992 | Yuchi | 340/511 |

*Primary Examiner*—Donnie L. Crosland
*Attorney, Agent, or Firm*—Max Fogiel

[57] ABSTRACT

First sensors measure physical quantities correlated with the heat release value of a fire source, and second sensors measure physical quantities correlated with the amount of the product of burning. At least a pair of one first sensor and one second sensor are arranged in a zone to be monitored. A first threshold of high sensitivity and a second threshold of low sensitivity are set at the first sensors. A third threshold is set at the second sensors. A pre-alarm is given only when the level of signals from the second sensors exceeds the third threshold. A fire alarm is given when the level of the signals from the second sensors exceeds the third threshold and when the level of signals from the first sensors exceeds the first threshold. The outputs from a plurality of such sensors detecting different objects, such as heat and smoke, are processed in the manner in which these outputs are combined together to reliably detect fires and to give a fire alarm. It is possible to improve the accuracy of detecting fires, and to reduce the incidence of false alarms.

11 Claims, 15 Drawing Sheets

| STATUS | THE FIRST SENSOR | | THE SECOND SENSOR | CONTROL |
|---|---|---|---|---|
| | HIGH SENSITIVITY THRESHOLD VALUE V1 | LOW SENSITIVITY THRESHOLD VALUE V2 | THRESHOLD VALUE V3 | |
| A | OFF | OFF | ON | α |
| B | ON | OFF | ON | β |
| C | ON | OFF | (ON) | β |
| D | OFF | ON | OFF | β |

Fig. 2

(CONDITIONS UNDER WHICH FALSE FIRE ALARM ARE SET OUT)

| | |
|---|---|
| NUMBER OF OBJECTS TO BE MONITORED | 1500 |
| TOTAL NUMBER OF SENSORS | 262152 |
| HEAT SENSORS | 62 % |
| SMOKE SENSORS | 38 % |
| TOTAL NUMER OF FALSE FIRE ALARMS | 7469 |
| FREQUENCY AT WHICH FALSE FIRE ALARMS ARE SET OUT (HEAT SENSORS) | $6.4 \times 10^{-2}$ [TIMES PER YEAR/PER SENSOR] |
| FREQUENCY AT WHICH FALSE FIRE ALARMS ARE SET OUT (SMOKE SENSORS) | $6.5 \times 10^{-2}$ [TIMES PER YEAR/PER SENSOR] |

PRIOR ART

Fig. 13

(CAUSES OF FALSES FIRE ALARMS)

| | |
|---|---|
| ① MAN-MADE CAUSES (COOKING, CIGARETTE, SMOKE, EXHAUST-GAS, CONSTRUCTION, HEATING WELDING, ETC) | 59.8% |
| ② CAUSES RELATED TO FUNCTION (DUST, STEAM, EQUIPMENT FAILURE, WEATHER CONDITIONS, INGRESS OF INSECTS, CHANGE IN SENSITIVITY, MOISTURE CONDENSATION) | 5.8% |
| ③ CAUSES RELATED TO MAINTENANCE | 0.6% |
| ④ CAUSES RELATED TO INSTALLATION | 0.4% |
| ⑤ UNKNOWN | 33.3% |

PRIOR ART

Fig. 14

(SENSITIVITY OF PHOTOELECTRIC SENSORS (FIRST TYPE) IS REPRESENTED BY HEAT RELEASE VALUES PER MATERIAL)

| BURNING METHODS | MATERIALS | SEIVSITITY (KW) |
|---|---|---|
| FLAME BURNING | TIMBERS | 2200 |
| | POLYURETHANE FOAM | 23 |
| | HEPTANE | 440 |
| SMOKE BURNING | TIMBERS | 0.16 |
| | COTTON WICK | 0.16 |

(SENSITIVITY OF DIFFERENTIAL HEAT SENSORS (FIRST TYPE) IS APPROXIMATELY 50 (KW) UNDER SAME CONDITIONS AS FOR PHOTOELECTRIC SENSORS)

PRIOR ART

Fig. 15

COMBINED METHOD OF DETERMINING FIRES

BACKGROUND OF THE INVENTION

1. Field of the Invention

The present invention relates to a method of determining fires in which outputs from a plurality of types of fire sensors monitoring different objects are processed in a manner in which the outputs are combined to detect the outbreak of fires and to give an alarm. More particularly, this invention pertains to a combined method of determining fires in which a plurality of thresholds are set at various types of sensors, and the outputs from the sensors are processed in a combined manner, thereby improving the accuracy of determining the outbreak of fires.

2. Description of the Related Art

FIG. 12 illustrates a fire determining system to which a conventional method of determining fires is applied. In this system, a plurality of sensors 1*a*–1*n* arranged at appropriate zones to be monitored are connected to a signal receiving device 2 through a signal transmission line. The device 2 continually receives signals transferred from the sensors, and thereby determines whether or not a fire has occurred. Once the signal receiving device 2 determined that a fire has occurred, it starts alarm devices 3, such as alarm ringing devices, and actuates fire-preventing equipment 4, such as fire doors, smoke dispersion preventing devices and automatic fire-extinguishing devices.

It is possible to employ the following sensors: sensors for determining fires on the basis of a rise or change in temperature or in the smoke density in the air. Such sensors include a so-called fixed-temperature heat sensor which generates signals when the temperature of the air exceeds a preset threshold; a differential heat sensor which monitors the ratio at which air temperature increases and generates signals when this ratio exceeds a preset ratio; and a smoke sensor which generates signals when the smoke density in the air exceeds a preset threshold.

The conventional fire determining method, to which the above sensors are applied, has the drawback of a so called false alarm, that is, when there is actually no fire, it determines that a fire has broken out, and sets out an alarm. FIG. 13 shows the results of investigating the actual conditions in which false alarms (without a fire) were given between 1980 and 1981 ("the results of investigating the actual conditions in which automatic fire alarm equipment sets out false alarms" by Tokyo Fire Defense Agency). FIG. 14 shows the results of analyzing the causes of false alarms on the basis of the above investigation. As obvious from the results shown in FIG. 13, six false alarms are sent from 1000 heat sensors, whereas six false alarms are sent from 100 smoke sensors. The incidence of false alarms from the smoke sensors is a problem compared with that of the heat sensors. As apparent from FIG. 14, these false alarms are rarely given because of the failure of equipment, such as the sensors, but mostly because of misreading man-made causes, such as smoke from cooking or cigarette.

To clarify the causes of false alarms from smoke sensors, the inventor of this invention empirically investigated the relationship between the sensitivity of smoke sensors and the magnitude of fire (heat release values). FIG. 15 shows the results of this investigation. For each burning method and material burned, the heat release value of the fire source is given under conditions where a photoelectric smoke sensor is provided on a 3-m high ceiling, and the fire source is provided on a floor surface. As the results of the investigation indicate, when the heat release value of the fire source is regarded as a criterion, the photoelectric smoke sensor has extremely high sensitivity to fires in a smoldering state; for example, it absolutely detects a small fire in the smoldering state at a level of 0.16 kW.

The sensitivity of photoelectric smoke sensors to fires in a flaming state varies greatly according to the type of material burned. The sensitivity of the photoelectric smoke sensor is higher than that of a differential heat sensor to a fire of a material, such as polyurethane, which produces a great amount of smoke. On the other hand, the sensitivity of the photoelectric smoke sensor is lower than that of the differential heat sensor to a fire of a material, such as timber, which produces a small amount of smoke.

Even when a fire source with a heat release value corresponding to 0.16 kW is placed, it is rare for smoke to rise to the ceiling because the temperature in an air stream is low. In other words, a heat source is required for generating an air stream which sends smoke up to the ceiling. If a temperature of 2 (deg) is required for the air stream to reach the ceiling, a heat release value required for such a rise in temperature is approximately 2.5 kW. The photoelectric smoke sensor (first type) operates under the conditions, using the above values, where the height of the ceiling is 3 m, a heat source corresponding to 2.5 kW and a smoke source corresponding to 0.16 kW smoldering are disposed on the floor surface. However, there are innumerable man-made occasions meeting such conditions. For instance, the combination of steam and heat from a heating system or of heat from a heating system and cigarette smoke, or smoke produced during cooking, welding, etc. in daily life. The photoelectric smoke sensor may thus be actuated in some cases depending on the conditions, even if a fire has not occurred.

By merely detecting smoke as a product of burning, limitations are established for distinguishing a real fire from a similar, man-made phenomenon. Originally, smoke sensors have an advantage of high sensitivity for detecting a smoldering state in an early stage of a fire. These smoke sensors, however, have the disadvantage of a high incidence of false alarms. As understood from FIG. 15, heat sensors have a characteristic of responding to the magnitude of a fire source (heat release value). However, there is a limit to the sensor's detection capability depending on the magnitude of the fire source.

SUMMARY OF THE INVENTION

The present invention has been made in view of the above problems. The object of this invention is therefore to provide a combined method of determining fires, in which the accuracy with which fires are detected is improved, and the incidence of false alarms is reduced.

In the fire determining method of this invention, outputs from a plurality of fire sensors monitoring different objects are processed in a manner in which the outputs are combined to detect the outbreak of fires and to give an alarm. This detection is made more reliable when at least one of a plurality of fire sensors near a signal receiving device in a fire determining system satisfies predetermined conditions.

To achieve the above object, in accordance with one aspect of this invention, there is provided a combined method of determining fires in which outputs from a plurality of fire sensors for detecting different objects are received by a signal processor in a receiving device disposed in a certain location, such as a central monitoring room, and signals from the signal processor are processed by a determining device so as to determine the outbreak of fires and to give an alarm, the combined method comprising the steps of: arranging at least a pair of one first sensor and one second sensor in a zone to be monitored, the first sensor measuring physical quantities correlated with the heat release value of a fire source, the second sensor measuring physical quantities correlated with the amount of a product of burning; setting a first threshold(V1) of high sensitivity and a second threshold(V2) of low sensitivity at the first sensor; setting a third threshold(V3) at the second sensor; giving a pre-alarm (a preliminary fire alarm) only when a signal level from the second sensor exceeds the third threshold(V3); and giving a fire alarm when the signal level from the second sensor exceeds the third threshold(V3) and when a signal level from the first sensor exceed the first threshold(V1).

The fire alarm may also be given when the signal level from the first sensor exceeds the second threshold(V2) of low sensitivity and when there is a hysteresis in which the signal level from the second sensor has once exceeded the third threshold(V3) and when the signal level from the first sensor exceeds the first threshold(V1).

The first sensor is a heat sensor and the second sensor is a smoke sensor. The first sensor, which measures physical quantities correlated with the heat release value of the fire source, includes a detector for detecting air temperature, an infrared detector for detecting the radiant intensity of the fire source, a detector for detecting the concentration of oxygen or of carbon dioxide. The second sensor, which measures physical quantities correlated with the amount of the product of burning, includes detectors for detecting densities of smoke and steam, detectors for detecting concentrations of carbon monoxide, of a hydrocarbon compound, of hydrogen sulfide, and of hydrogen cyanide.

When the signal level from the second sensor continuously exceeds the third threshold(V3) for more than a predetermined amount of time, smoke controlling equipment, such as a smoke vent and a fire door, is started controllably. The pre-alarm is given in such a manner that an instruction for confirming that a fire has occurred is given to monitoring personnel or the like for a building and/or in such a manner that a broadcast or the like for attracting the attention of people is made in the building, and the fire alarm is given to people in the building by sounding bells or the like and/or in such a manner that the fire alarm is automatically reported to a fire station and the like.

The receiving device, the fire determining device and a transmission interface are provided for each set of the first sensor and the second sensor in a zone to be monitored, and the results of determination performed by the fire determining device are transferred to the signal processor. The first sensor, the second sensor, the receiving device, and the determining device are built into one sensor, and the results of determination performed by the fire determining device are transferred to the signal processor through a transmission interface provided in a base for attaching the sensor.

Thus, according to the fire determining method of this invention, the heat release value of a fire source is used as a primary and prior criterion to other criteria in determining fires. When a fire is detected by sensing only the product of burning, a pre-alarm is given, thereby reducing the incidence of false alarms.

First, when people are able to immediately confirm a fire site, sensors are not actuated which may frequently send false alarms ascribable to the product of burning; consequently, an alarm of great urgency is not given. It is thus possible to avoid confusion caused as, for example, by sounding alarm bells inadvertently. Second, in addition to the product of burning, physical quantities correlated with the heat release value are measured, and the results are combined together to eventually determine whether a fire has broken out, thus realizing a method of determining fires in accordance with actual conditions. The fire determining method of this invention is capable of detecting fires more quickly and with higher sensitivity than when only the conventional sensors are employed.

BRIEF DESCRIPTION OF THE DRAWINGS

FIG. 2 is a view illustrating criteria of determining a fire alarm according to the embodiment;

FIG. 13 is a chart illustrating problems with the conventional fire determining method;

FIG. 14 is a chart illustrating problems with the conventional fire determining method; and FIG. 15 is a chart illustrating problems with the conventional fire determining method.

DESCRIPTION OF THE PREFERRED EMBODIMENTS

Figure 1:
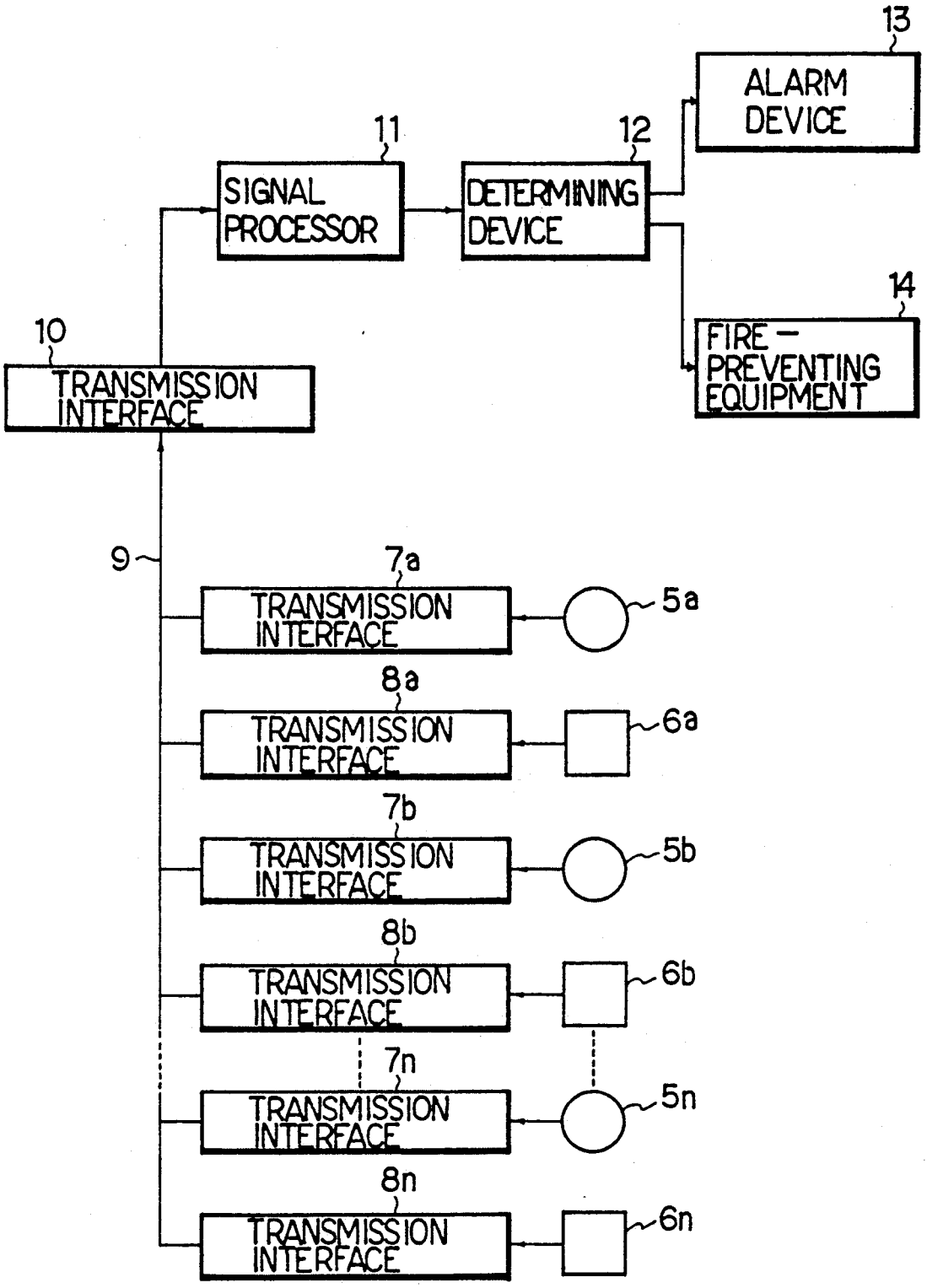
FIG. 1 is a view illustrating the structure of an embodiment of a fire determining system to which a method of determining fires according to the present invention is applied.

An embodiment of the present invention will be described below. FIG. 1 shows an embodiment of a fire determining system to which a method of determining fires according to this invention is applied.

In FIG. 1, reference characters 5a–5n denote first sensors which measure physical quantities (temperature of air, etc.) correlated with heat release values, and outputs signals indicating the results of such measurements. Reference characters 6a–6n denote second sensors which measure physical quantities (smoke density, etc.) correlated with the product of burning, and output signals indicating the results of such measurements. At least a pair of one first sensor and one second sensor may be arranged in each zone to be monitored, or one second sensor and a plurality of the first sensors may be combined together to be arranged in each zone to be monitored, or a plurality of the first and second sensors may be combined together to be arranged in each zone to be monitored.

The first sensors 5a–5n are all connected to a signal transmission line 9 through predetermined transmission interfaces 7a–7n, respectively, and similarly, the second sensors 6a–6n are all connected to the signal transmission line 9 through predetermined transmission interfaces 8a–8n, respectively. The transmission line 9 is in turn connected to a signal processor 11 through another transmission interface 10. The signal processor 11 is disposed at a receiving device in a certain location, such as a central monitoring room.

The signals from the first and second sensors 5a–5n and 6a–6n are processed in a time-division manner so as to be transmitted to the signal processor 11 at regular time intervals (for instance, every 5 seconds). The signal processor 11 performs a signal process every time it receives the signals from the sensors, and outputs them to a determining device 12.

The determining device 12 first processes the signals transmitted from the plurality of sensors via the signal processor 11, and then determines whether there is a fire. If there is or may be a fire, the determining device 12 outputs a control signal in accordance with predetermined types of alarms, this control signal starting an alarm device 13. At this phase, the determining device 12 is also capable of outputting a control signal which actuates fire-preventing equipment 14.

In this embodiment, the alarm device 13 possesses at least two types of alarm means, either of which is started in response to the signal from the determining device 12, thereby setting out an alarm. The fire-preventing equipment 14 includes fire doors, smoke dispersion preventing devices, automatic fire-extinguishing devices and so forth.

The signal processor 11 first performs an operation for eliminating noise from the signal received, and then performs a signal process according to the types of signals. More specifically, the signal processor 11 processes the signals from the first sensors 5a–5n in a manner different from the manner in which the signals from the second sensors 6a–6n are processed. This is because the type of signal from the first sensors 5a–5n differs from that from the second sensors 6a–6n. For example, when the second sensors 6a–6n are smoke sensors, the signal processor 11 converts the signals received from these sensors into data indicating an extinction ratio, which data corresponds to calibration data that has been stored previously in a memory of the signal processor 11. In another example, when the first sensors 5a–5n are temperature sensors, the signals received from these sensors are used directly. However, it is preferable that these signals be converted into quantities correlated with the heat release value of a fire source, such as a temperature rise ratio, disclosed in, for example, Japanese patent Laid-Open No. 64-55696. Alternatively, these signals may be converted into property values of the fire source by using a mathematical expression representing the relationship between the property values of the fire source (heat release value, and the amount of smoke and gas generated) and physical values (temperature, and smoke and gas densities) measured near a ceiling.

If the signals received contain a little noise, an operational function for eliminating noise mentioned above may not be provided in the signal processor 11. If the first and second sensors 5a–5n and 6a–6n each have a function which outputs signals indicating quantities correlated with the signals indicating the results of the measurements, an operational function for signal conversion may not be provided in the signal processor 11. For instance, when a smoke sensor utilizing extinction through smoke is employed, signals proportional to the smoke density are obtained directly from such a smoke sensor; consequently, an operational process for signal conversion may not be provided. A sensor has an air chamber, whose construction is similar to that of a differential (rate of rise) heat sensor utilizing variations in pneumatic pressure, and the pneumatic pressure of the sensor is used as an output. When such a sensor is employed, signals proportional to a rise in temperature are obtained directly from the sensor; as a result, an operational process for signal conversion may not be provided. Alternatively, a sensor may be employed in which an electrical differentiation circuit and a temperature-sensing element, which element outputs signals proportional to temperatures, are combined together to output signals proportional to a rise in temperature.

The determining device 12 processes the signals from the first sensors 5a–5n in a manner suitable for these sensors, and also processes the signals from the second sensors 6a–6n in a manner suitable for these sensors. In other words, the determining device 12 compares the two types of signals with a plurality of thresholds, and outputs different control data in accordance with the results of the comparison. The determining device 12 then outputs alarm data which determines types of alarms on the basis of the control data. The relationship between the thresholds of the first sensors and those of the second sensors is established as shown in FIG. 2.

As illustrated in FIG. 2, a low threshold V1 and a high threshold V2 are set at the signals output from the first sensors 5a–5n. This setting is based on the results of experiments. The low threshold V1 is used for detecting signals with a high degree of sensitivity, and the high threshold V2 is used for detecting signals with a low degree of sensitivity. A threshold V3 is set at the signals from the second sensors 6a–6n. This setting is based on the results of the experiments. (The relationship $0<V1<V2$ is established.) In this embodiment, it is assumed that temperature sensors are used as the first sensors 5a–5n, smoke sensors as the second sensors 6a–6n, and that the threshold V1 is set at 45° C.; the threshold V2 is set at 60° C.; and threshold V3 is set at 5%/m.

FIG. 2 shows that the determining device 12 outputs the alarm data indicating control contents (a), when an object to be monitored is in status A, when the threshold of the signal from at least any one of the second sensors 6a–6n is more than the threshold V3, and when the thresholds of all the signals from the first sensors 5a–5n are smaller than the thresholds V1 and V2.

As shown in FIG. 2, in status A, the thresholds V1, V2 and V3 are in the order of "OFF", "OFF" and "ON". These thresholds are represented by 3-bit data (001), which is decoded to form 2-bit alarm data (D2 and D1). For example, the alarm data indicating the control contents (a) is represented by (10); alarm data indicating control contents (b) described later is represented by (01); and data indicating that no alarm is required is represented by (00). These items of alarm data are transferred to the alarm device 13 and the fire-preventing equipment 14.

Figure 3:
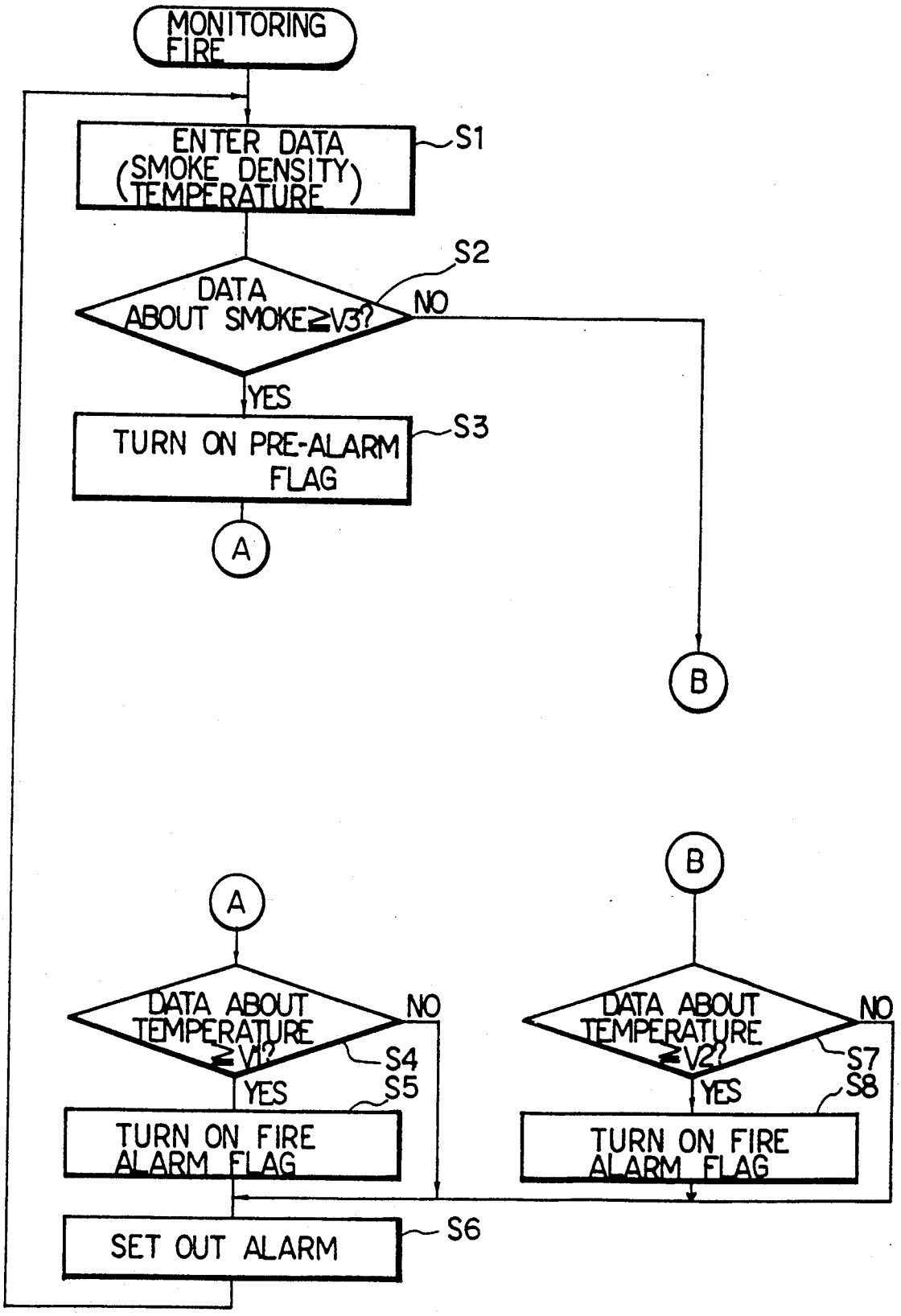
FIG. 3 is a flowchart illustrating the process of determining fires in status A, B and D.

FIG. 3 is a flowchart showing the method of determining fires according to this invention when the object to be monitored is in status A, B or D of FIG. 2.

The fire determining method will be described in status A. Status A is a state in which the heat release value measured by the first sensors is small enough to determine that a fire has occurred, however, the amount of smoke measured by the second sensors is sufficient enough to determine that a fire has occurred. Such a state is applicable to many occasions where the measurements described above result from smoke from cigarette or cooking. In such a case, it is extremely difficult to determine whether a fire has broken out. However, since there is a probability of a fire, an alarm (pre-alarm) indicating a low degree of emergency is sent to the alarm device 13 so as to instruct monitoring personnel to confirm that a fire has broken out or to call the attention of people in the building to the fire.

The fire determining method in status A will be described with reference to FIG. 3. First, in step 1 (hereinafter S1), data (regarding, for example, temperatures and smoke) is entered from the first and second sensors. In S2, data (such as smoke density) from the second sensors is compared with the threshold V3. If the data from the second sensors exceeds the threshold V3 in status A, the flow proceeds to S3 where a pre alarm flag is turned on. In S4, the data (regarding, for example, temperatures) from the first sensors is compared with the threshold V1. If it does not exceed the threshold V1 in status A, the flow proceeds to S6. In S6 an alarm is given, depending on whether the pre-alarm flag or a fire alarm flag is turned on. In other words, if the pre-alarm flag is on, the determining device 12 outputs a pre-alarm command to the alarm device 13 which in turn sets out the pre-alarm, whereas if the fire alarm flag is on, the determining device 12 outputs a fire alarm command to the alarm device 13 which in turn sets out a fire alarm. In status A, if the pre-alarm flag is on (S3) and the fire alarm flag is off, the pre-alarm is given. In this way, the pre-alarm is sent to the alarm device 13. The fire-preventing equipment 14 is not actuated when alarm data only corresponding to status A is available.

A description will be given of the fire determining method in a state in which the object to be monitored is in status B. Status B is a state in which the signal output from any of the first sensors 5a–5n has an output between the thresholds V1 and V2, and in which the signal output from any of the second sensors 6a–6n, which are paired with the first sensors, has an output greater than the threshold V3. In such a case, the determining device 12 outputs alarm data indicating the control contents (b) shown in FIG. 2. As illustrated in FIG. 2, in status B, the thresholds V1, V2 and V3 are in the order of "ON", "OFF" and "ON". These thresholds are represented by 3-bit data (101) which is decoded to generate alarm data indicating the control contents (b). The alarm data is transferred to the alarm device 13 and the fire-preventing equipment 14.

Status B is applied where the heat release value corresponds to that of a fire in its early stage and the amount of smoke generated corresponds to that of the fire. An alarm of great urgency therefore must be given. The alarm data, indicating the control contents (b), is transferred to the alarm device 13 which in turn sets out a fire alarm and automatically informs an appropriate organization, such as a fire station. The fire alarm is sent not only to monitoring personnel but also to all people in the building. At this phase, the fire-preventing means 14 may also be actuated.

The fire determining method in status B will be described with reference to FIG. 3. First, in S1 data is entered, and the data from the second sensors is compared with the threshold V3 in S2. If it exceeds the threshold V3, the flow proceeds to S3, S4. If the data from the first sensors exceeds the threshold V1, the flow proceeds to S5 where the fire alarm flag is turned on. The flow then proceeds to S6 where the fire alarm command is output to the alarm device 13 which in turn sets out a fire alarm, and the fire-preventing equipment 14 is actuated if required.

A description will now be given of a state in which the object to be monitored is in status C. Status C is a state in which the signal output from any of the first sensors 5a–5n has an output between the thresholds V1 and V2, and in which the signal output from the second sensors 6a–6n, which are paired with the first sensor, has once had an output greater than the threshold V3 within the predetermined time period. Status C corresponds to a transitional state in which a fire develops from its early stage to a full-scale fire. Thus there is a risk that the fire may spread. The determining device 12 outputs the alarm data indicating the control contents (b). As shown in FIG. 2, the thresholds V1, V2 and V3 are in the order of "ON", "OFF" and "ON", however the thresholds of the outputs from any of the second sensors are turned on after a hysteresis during a fixed amount of time has been examined. The thresholds are represented by 3-bit data (101). The alarm data, which corresponds to the 3-bit data and indicates the control contents (b), is transferred to the alarm device 13 which in turn sets out the fire alarm and automatically informs an appropriate organization, such as a fire station. The fire alarm is given to not only monitoring personnel but also all people in a building. At this phase, the fire-preventing means 14 may also be actuated.

Figure 4:
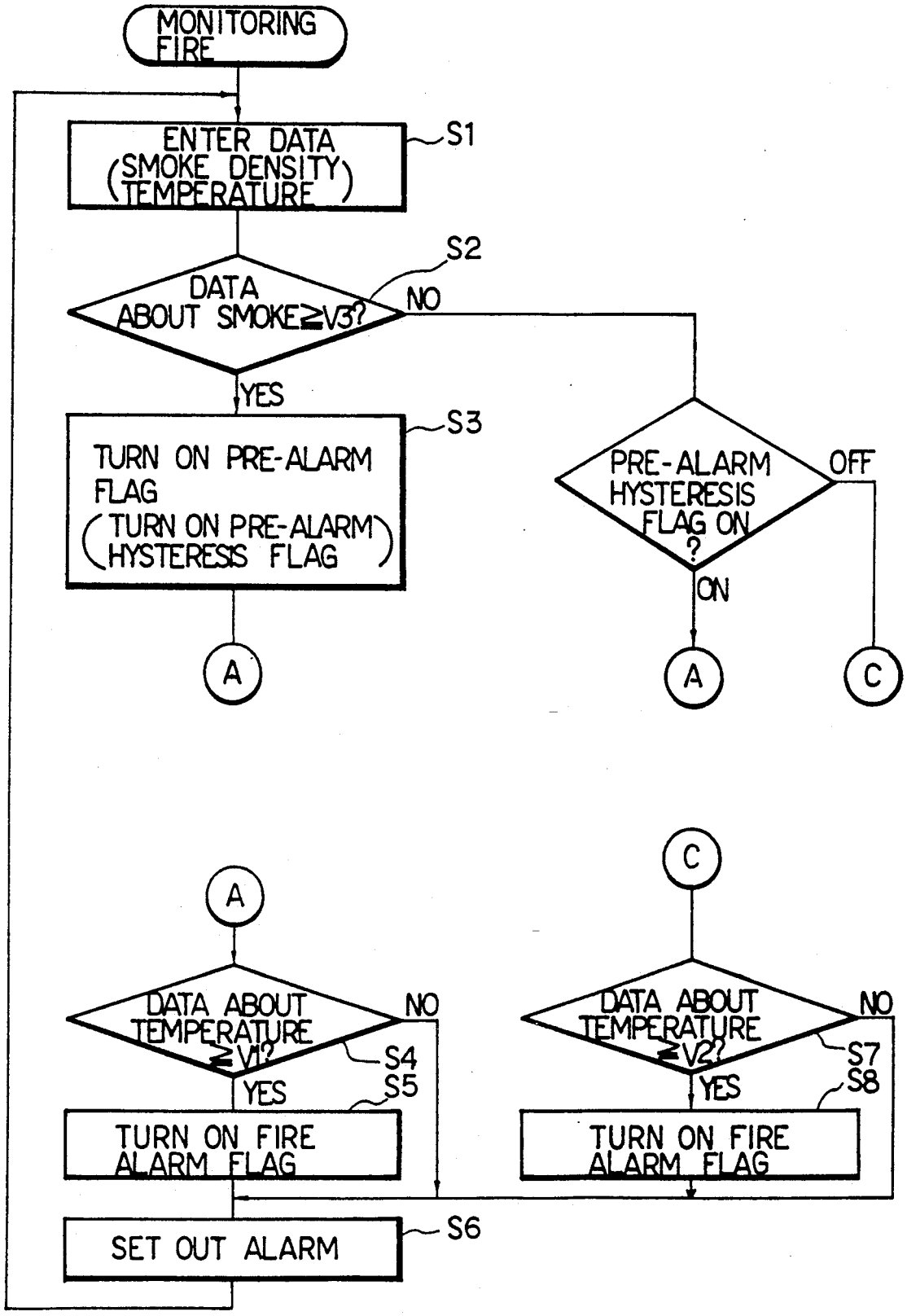
FIG. 4 is a flowchart illustrating the process of determining fires in status C.

The fire determining method in status C will be described with reference to FIG. 4. In the same manner as in statuses A and B, in S1 data is entered, and the data from the second sensors is compared with the threshold V3 in S2. In status C, if the data from the second sensors does not currently exceed the threshold V3, the flow proceeds to S11.

Status C is a state in which the data from the second sensors has once exceeded the threshold V3. In such a case, the flow proceeds from S2 to S3 where the pre-alarm flag as well as the pre-alarm hysteresis flag showing the status which the pre alarm was given are turned on and the pre-alarm is given in S6. As mentioned above, status C is a state in which the data from the second sensors does not currently exceed the threshold V3.

In S11 a determination is made whether the pre-alarm hysteresis flag is on or off. In status C, if the pre-alarm hysteresis flag is on, the flow proceeds to S4 where the data from the first sensors is compared with the threshold V1. If it exceeds the threshold V1, the flow proceeds to S5 where the fire alarm flag is turned on. The fire alarm is then given in S6.

A description will be given of a state in which the object to be monitored is in status D. Status D is a state in which the signal output from any of the first sensors 5a–5n has an output exceeding the threshold V2. This state corresponds to a full-scale fire generating a high heat release value. Irrespective of the signals output from the second sensors, a determination is made that a fire has occurred, and the determining device 12 outputs the alarm data indicating the control contents (b). As shown in FIG. 2, the thresholds V1, V2 and V3 are in the order of "OFF", "ON" and "OFF", and are represented by 3-bit data (010). The alarm data, which corresponds to the 3-bit data and indicates the control contents (b), is transferred to the alarm device 13 and the fire-preventing equipment 14. As a result, the alarm device 13 sets out a fire alarm of great urgency and automatically informs an appropriate organization, such as a fire station. The fire alarm is sent to not only monitoring personnel but also all people in a building. At this phase, the fire-preventing means 14 may also be actuated.

The fire determining method in status D will be described with reference to FIG. 3. The flow proceeds to S1, S2 and S7 if the data from the second sensors does not exceed the threshold V3. In S7 the data from the first sensors is compared with the threshold 2. If it exceeds the threshold 2, the flow proceeds to S8 where the fire alarm flag is turned on. The fire alarm is then given in S6.

Figure 5:
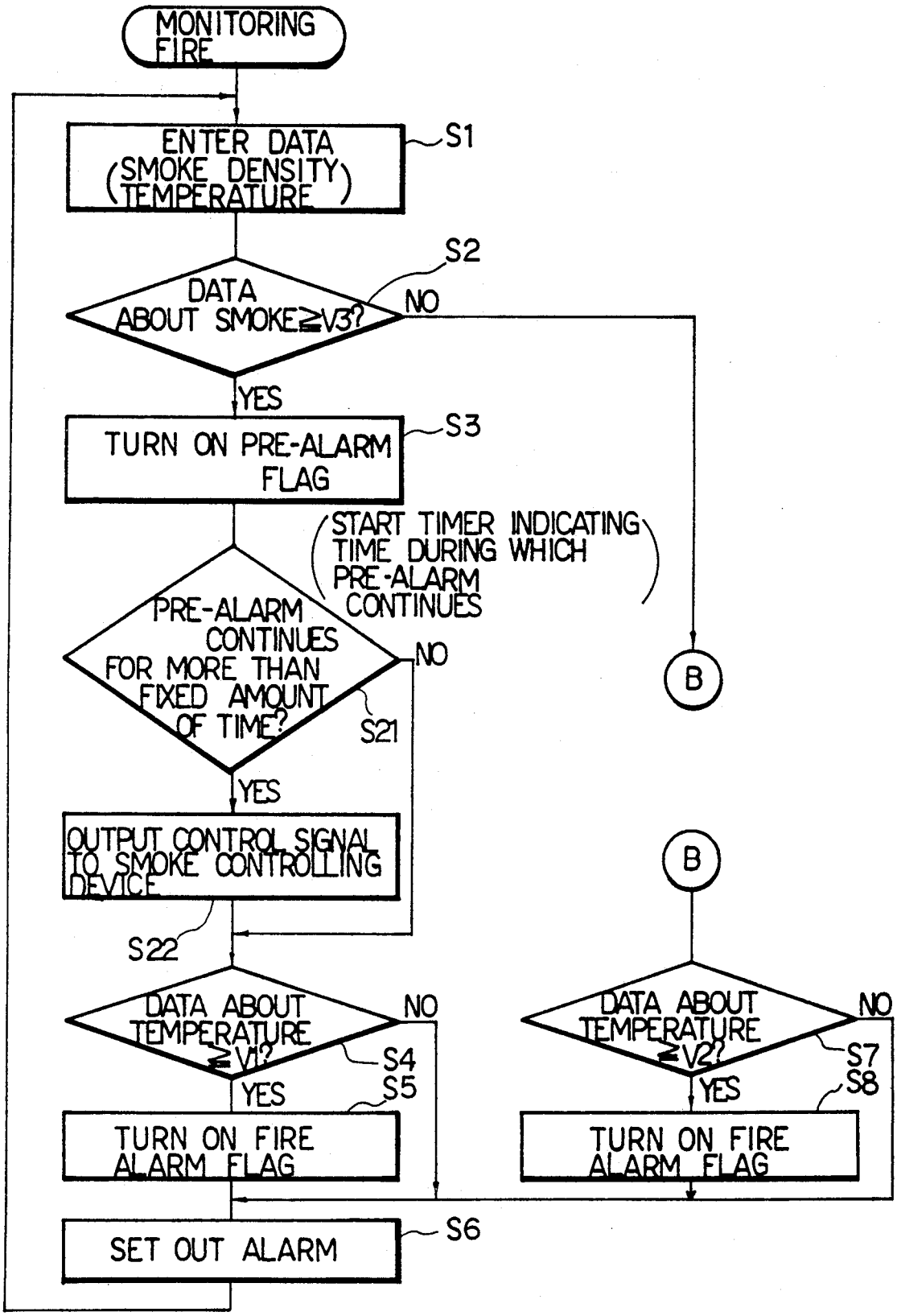
FIG. 5 is a flowchart illustrating the process of determining fires when data regarding smoke continuously exceeds a threshold V3 for more than a predetermined amount of time.

A description will be given of the fire determining method when the data (regarding smoke) from the second sensors continuously exceeds the threshold V3 for more than a predetermined amount of time. FIG. 5 is a flowchart showing the fire determining method in such a case.

In this case too, the flow proceeds to S1, S2 and S3 if the data from the second sensors exceeds the threshold V3. In S3 the pre-alarm flag is turn on and at the same time a timer starts to operate, which timer indicates the time during which a pre-alarm continues. In S21, a determination is made whether the pre-alarm continues for more than a fixed amount of time. If it does not continue for more than the fixed amount of time, the data from the first sensors is immediately compared with the threshold V1 in S4. If the data from the first sensors is equal to or more than the threshold V1, the flow then proceeds to S5, S6 and so on. On the other hand, if the pre-alarm continues for more than the fixed amount of time, the flow proceeds to S22 where a control signal is output to a smoke controlling device. The flow then proceeds to S4, S5, S6 and so forth.

Countermeasures, such as smoke-preventing measures, can thus be taken against a fire when the data from the second sensors exceeds the threshold V3 for a long period of time, that is, when smoke is produced for more than a predetermined amount of time, even if the alarm command is not output because a rise in temperature has not yet been confirmed after it has been confirmed that the data from the second sensors exceeds the threshold V3 and that smoke has been emitted.

If the signals output from all the sensors do not exceed the thresholds, the flow proceeds to S1, S2, S7 and S6. A determination is then made that there is no fire because neither the pre-alarm flag nor the fire alarm flag are turned on. The alarm command is not output, nor is the alarm device 13 or the fire-preventing equipment 14 actuated.

Thus, in the fire determining method of this invention, the physical quantities, such as heat release values, measured by the first sensors 5a–5n are primarily used as criteria, and the physical quantities, such as the amount of smoke, measured by the second sensors 6a–6n are secondarily used as criteria for determining fires.

The manner in which the fire determining method thus employed will be described below.

Figure 6:
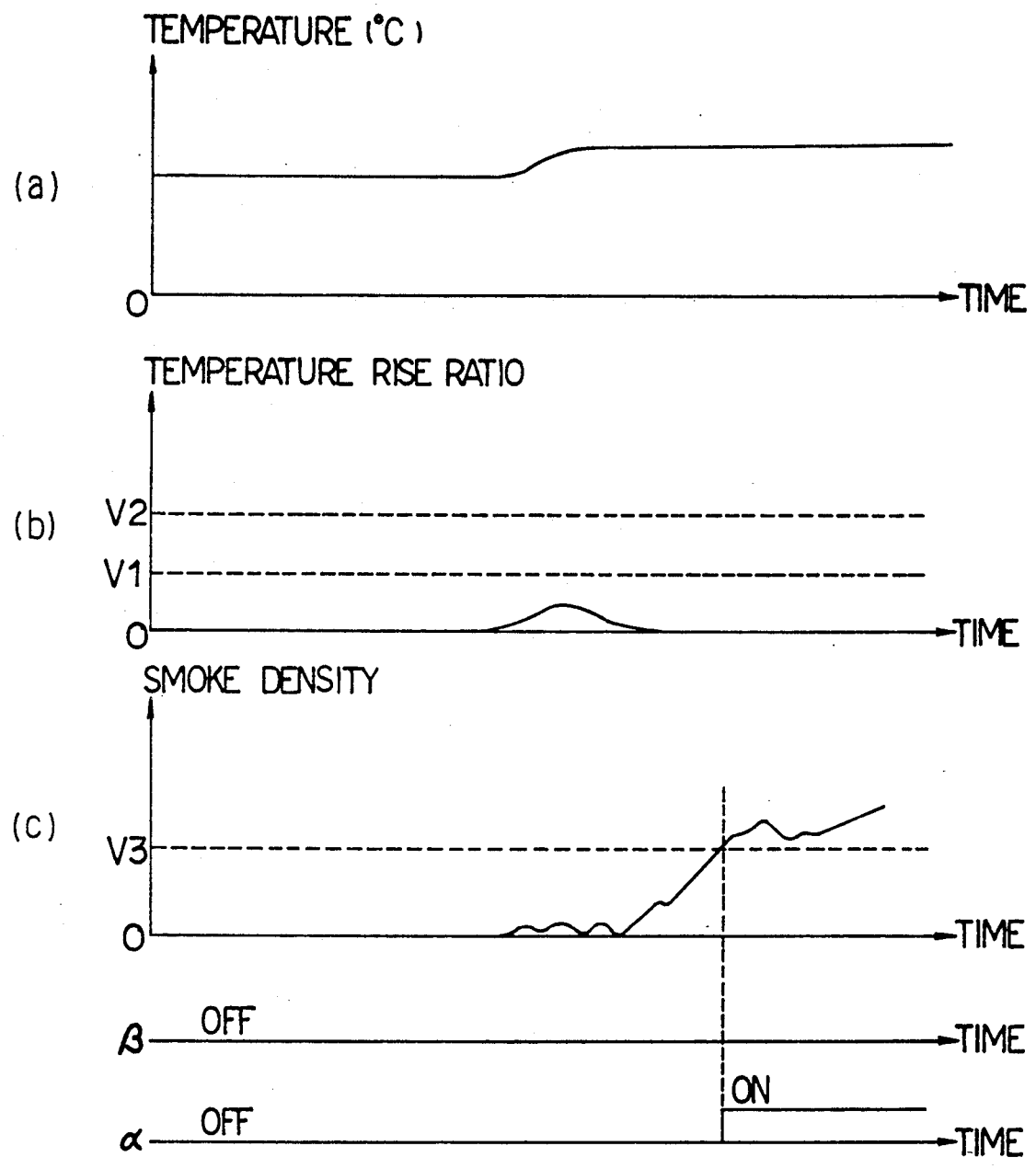
FIG. 6 is a timing chart illustrating the operation of the embodiment in a situation where a fire is monitored actually.

FIG. 6 shows typical outputs from the sensors near a ceiling and also shows control data corresponding to such outputs. These outputs are obtained if temperature and smoke density vary during ordinary cooking. In this embodiment, a temperature signal (a) is converted by the signal processor 11 to a signal (b) which indicates a temperature rise ratio. The determining device compares the signal (b) with the thresholds. Variations (c) in smoke density are measured as sown in FIG. 6. The state shown in FIG. 6 corresponds to status A in which if a smoke density exceeds the threshold V3, an alarm process of a low degree of urgency is performed. The alarm data, indicating the control contents (b), is transmitted during the alarm process.

Figure 7:
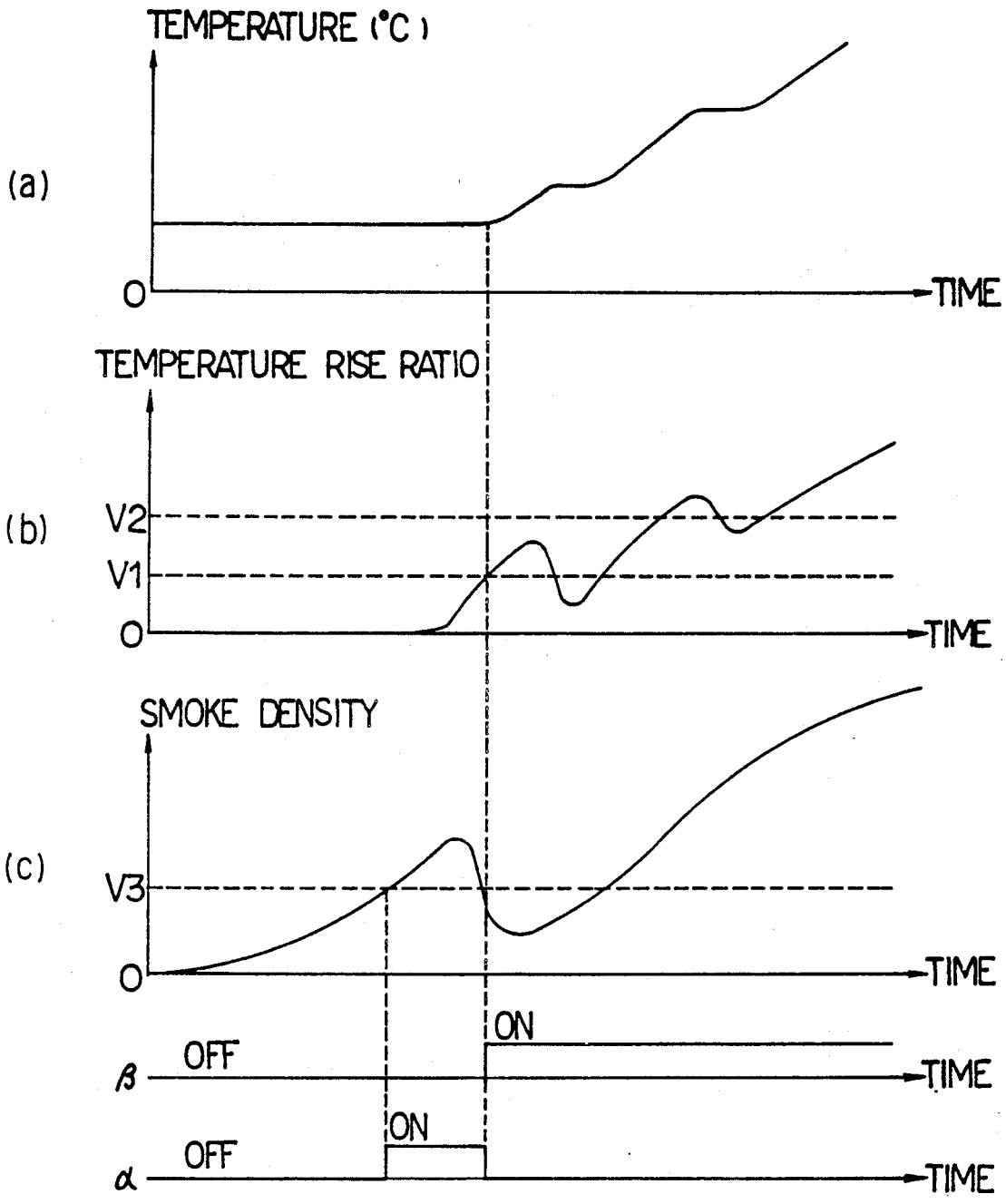
FIG. 7 is a timing chart illustrating the operation of the embodiment in another situation where a fire is monitored actually.

FIG. 7 shows typical outputs from the sensors, and control data corresponding to such outputs. The sensors operate when a fire breaks out which develops from a smoldering state to a flaming state. In the smoldering state, only the smoke sensors operate, and the alarm process of a low degree of urgency is performed, as shown in FIG. 7 (c). The alarm data, indicating the control contents (b), is transmitted during the alarm process. The amount of smoke decreases temporarily at an early stage of a fire which may develop to a flaming state. However, the outputs from the smoke sensors have once exceeded the threshold V3. On the basis of such a hysteresis the state shown in FIG. 7 (c) corresponds to status C of FIG. 2, and an alarm process of great urgency is carried out when the level showing a temperature rise ratio exceeds the first threshold V1.

Figure 8:
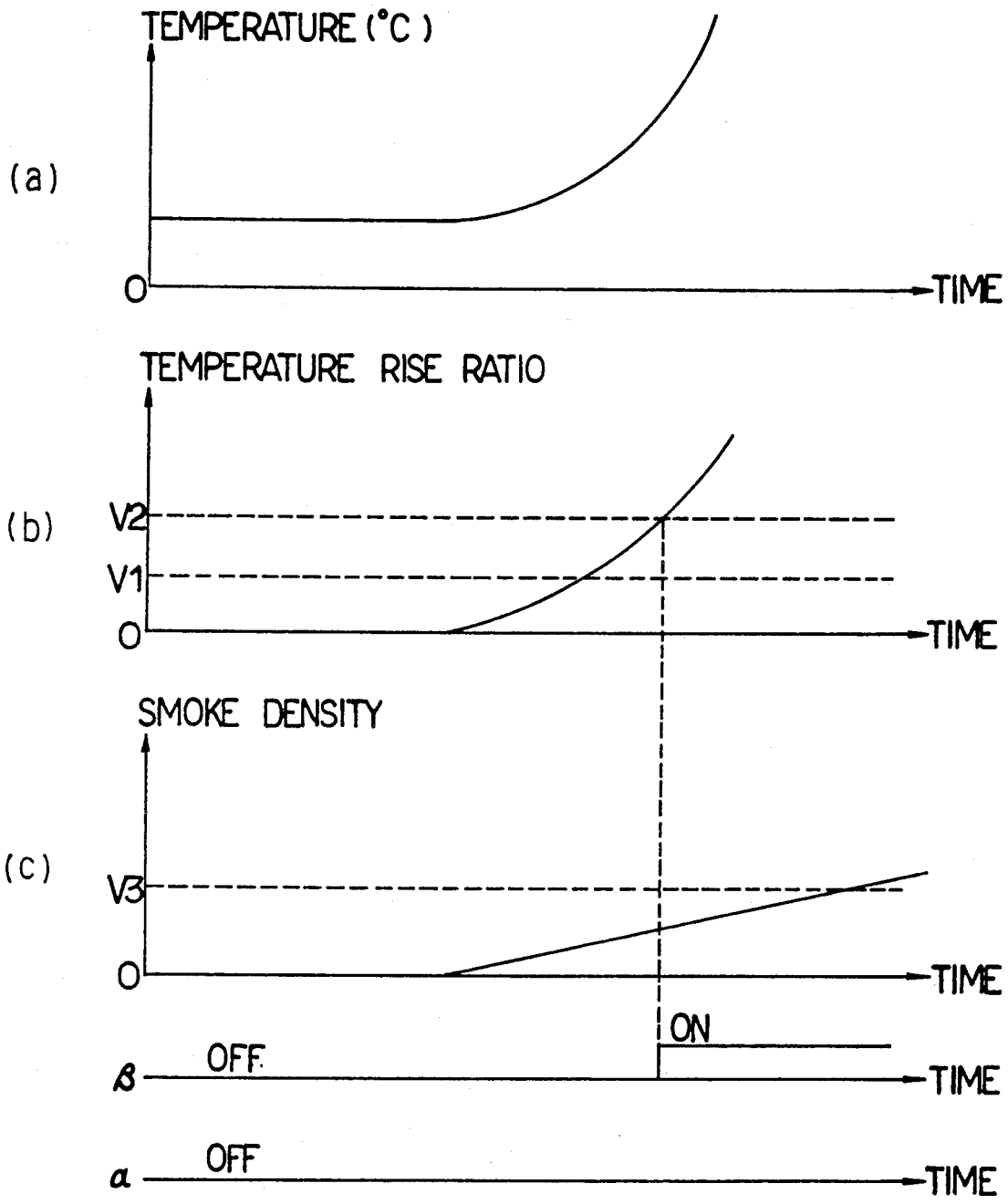
FIG. 8 is a timing chart illustrating the operation of the embodiment in a further situation where a fire is monitored actually.

FIG. 8 shows a typical state in which a fire develops not from the smoldering state but directly from a flaming state.

In the flaming state, generally there are a few products of burning, and therefore the amounts of the outputs from devices, like smoke sensors, are small. Thus, heat release values must increase greatly before the smoke sensors alone detect whether a fire has occurred. In the flaming state, however, as shown in FIG. 8(b), since the temperature exceeds the threshold V2 at an early stage of a fire, the alarm process of great urgency is performed, even when the smoke density does not reach the threshold V3. Such a state corresponds to status D shown in FIG. 2.

As has been described above, this embodiment is capable of performing the process of determining fires in accordance with actual conditions. It is therefore possible to reduce the incidence of false alarms compared with the conventional method. In the above embodiment, a temperature rise ratio is regarded as a threshold for determining fires. However, it is also possible to employ a fixed temperature method in which predetermined temperatures are set at the thresholds V1 and V2, whereby the outbreak of fires is determined.

Figure 9:
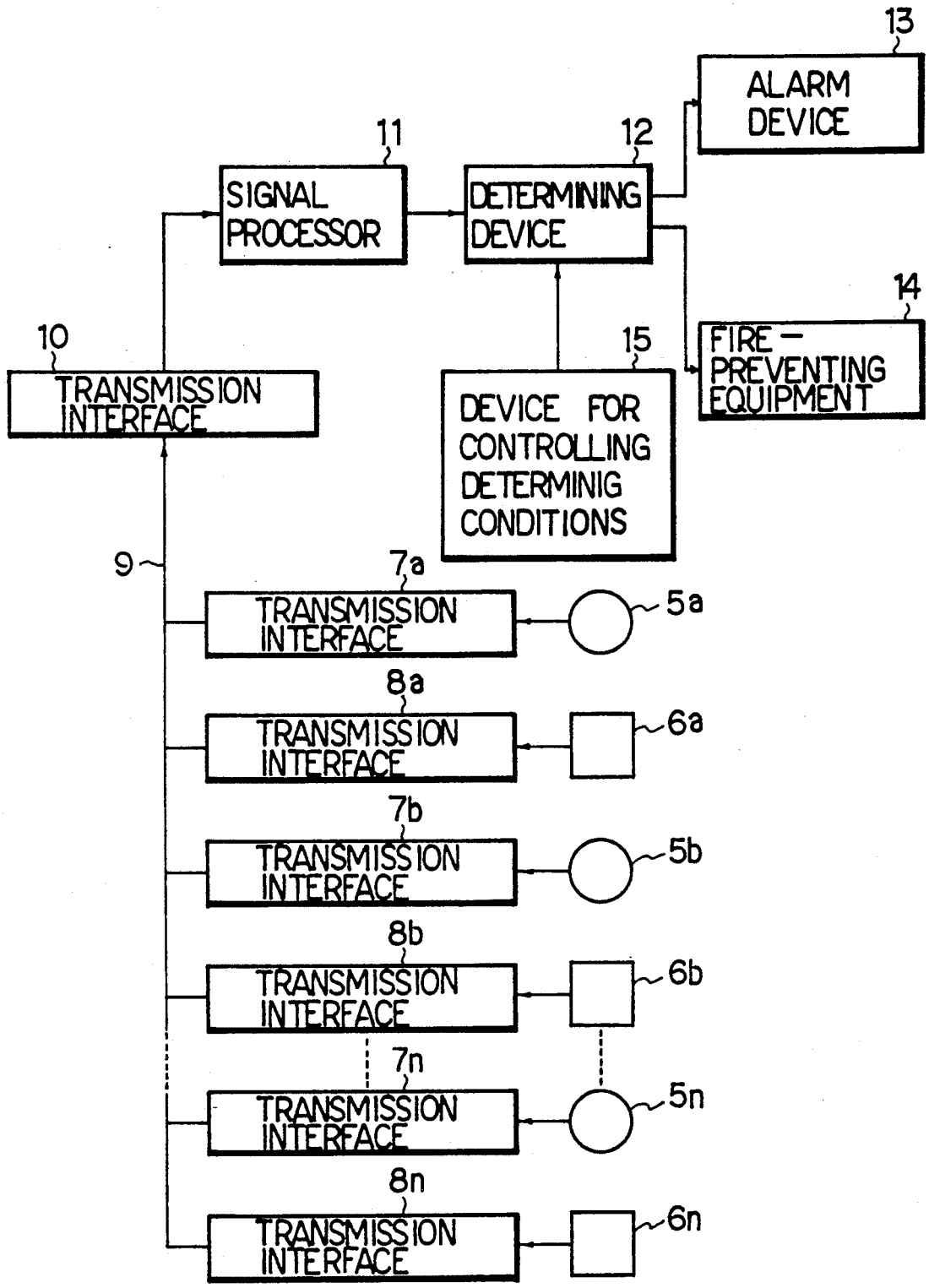
FIG. 9 is a view illustrating the structure of a second embodiment of a fire determining system to which method of determining fires according to this invention is applied.

A second embodiment of this invention will now be described. FIG. 9 shows the structure of a fire determining system according to the second embodiment. The structure of the fire determining system is such that a device 15 (hereinafter called a control device 15), for controlling conditions under which a determining device 12 operates, is added to the fire determining system of FIG. 1.

In this embodiment, the control device 15 changes the criteria on which the determining device 12 determines a fire. This change is based on various conditions. More specifically, the control device 15 changes the above criteria, depending on whether or not in a building there is full-time personnel in charge of protecting disasters, or whether or not the building is in such a state that countermeasures can be taken against an emergency. Such conditions can be set in various manners, such as by operating a switch on the control device 15 or by setting a time in a condition-setting portion with a timer function. Means may be provided in which an infrared sensor detects whether the personnel mentioned above is in their office, thus automatically setting the desired conditions.

A fire determining method will be described in detail when the conditions are set. When the personnel in charge of protecting disasters is not in their office, an alarm process of a low degree of urgency is performed even in status A. When the personnel in their office, the alarm process is switched to that for a pre-alarm shown in FIG. 2. Fires can thus be determined with a higher degree of accuracy than that of the conventional method.

In addition to the control device 15, means for continually monitoring the abnormality of the fire determining system may also be provided as part of this system, or another means for monitoring the abnormality of each sensor may be provided, thereby reducing the incidence of false alarms.

Figure 10:
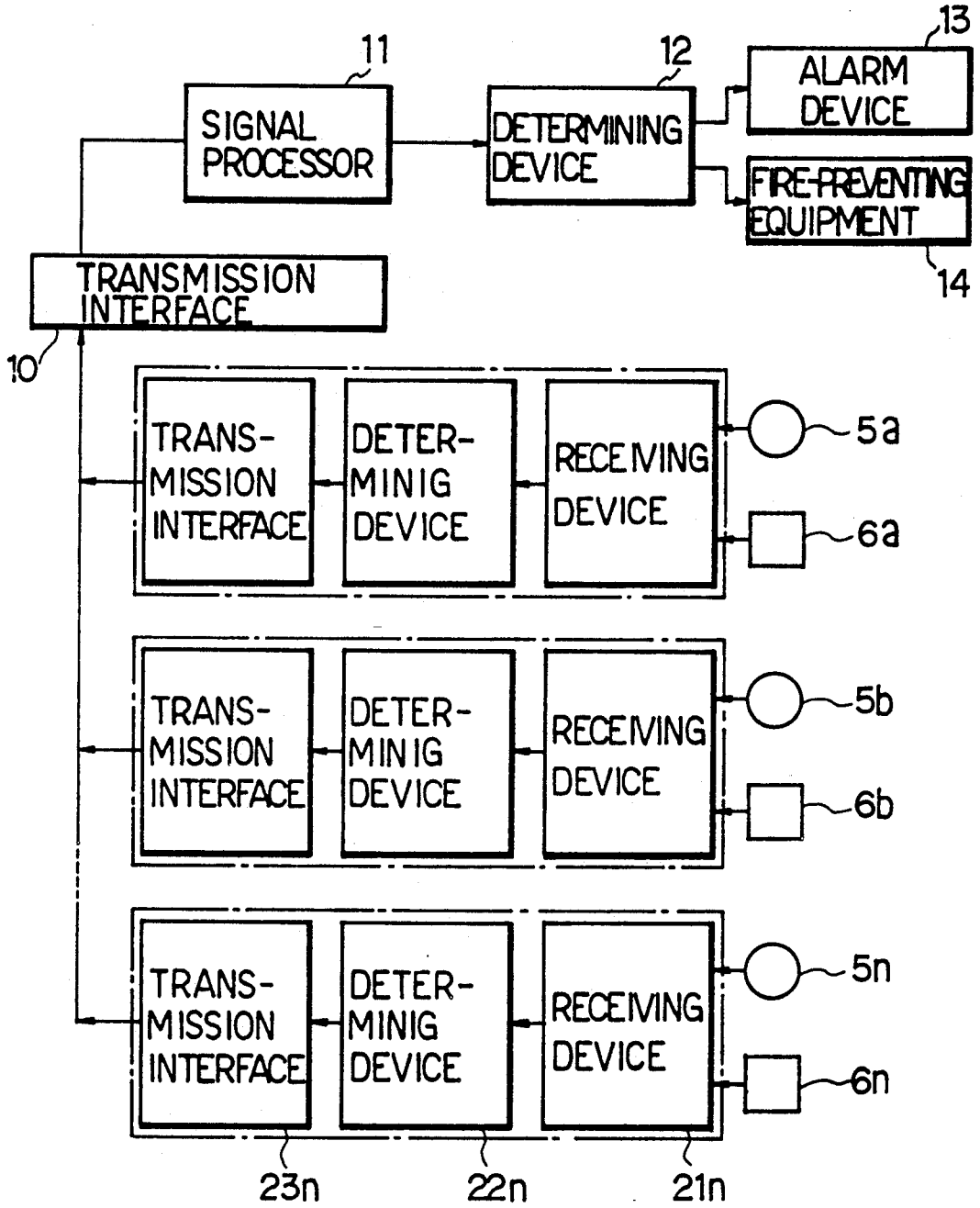
FIG. 10 is a view illustrating the structure of a third embodiment of a fire determining system to which the fire determining method of this invention is applied.

FIG. 10 shows the structure of a fire determining system according to a third embodiment of this invention. In this embodiment, a receiving device 21, a determining device 22 and transmission interface 23 are provided for a first sensor 5*a* and a second sensor 6*a*, both sensors forming a pair. The results of determining whether a fire has occurred are transmitted to a signal processor 11 via a transmission interface 10 through which all signals from the fire determining system are transferred. The signal processor 11 is disposed at a receiving device in a certain location, such as a central monitoring room. A control device 12 controls an alarm device 13 and other devices on the basis of signals from the signal processor 11.

Figure 11:
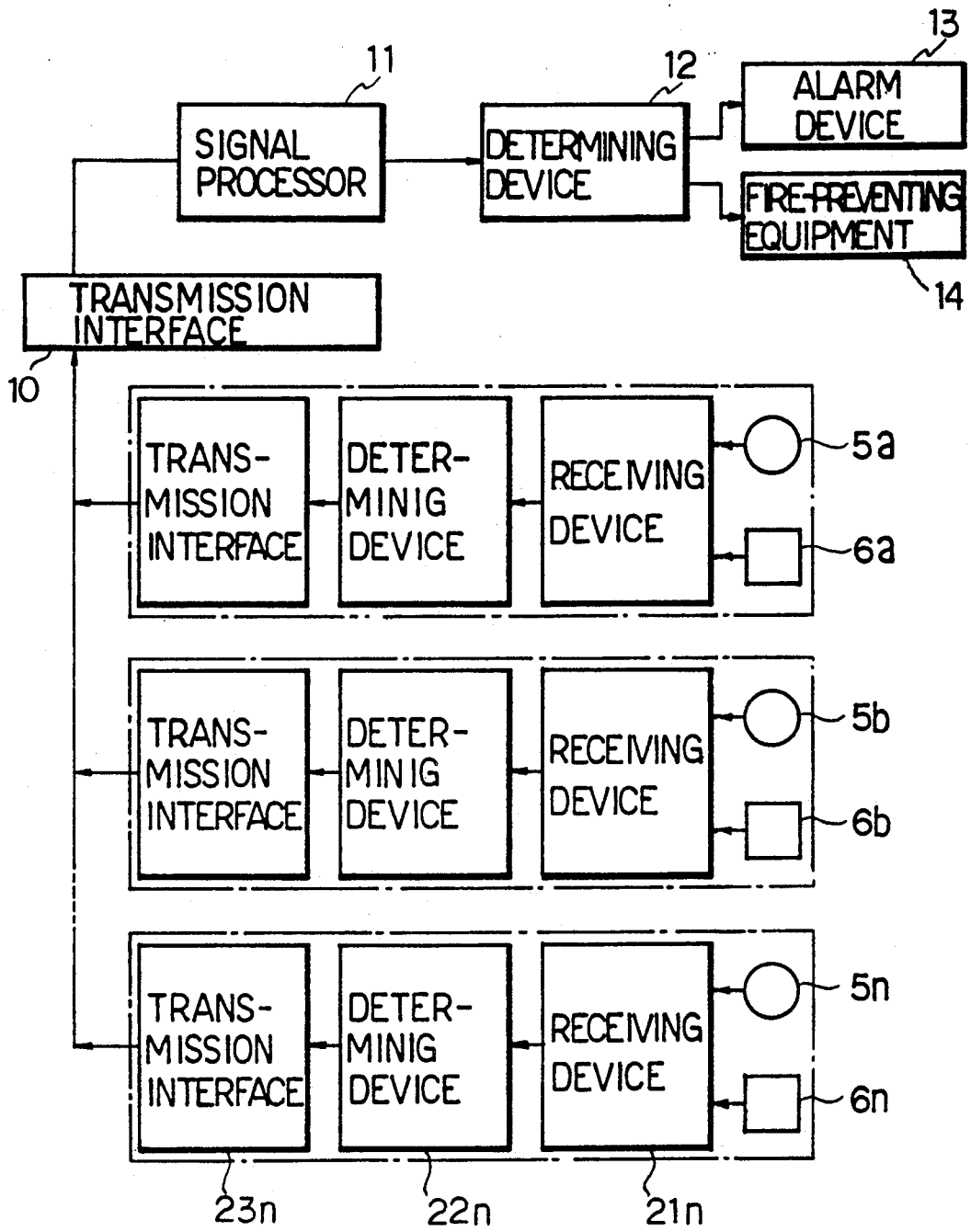
FIG. 11 is a view illustrating the structure of a fourth embodiment of a fire determining system to which the fire determining method of this invention is applied.
Figure 12:
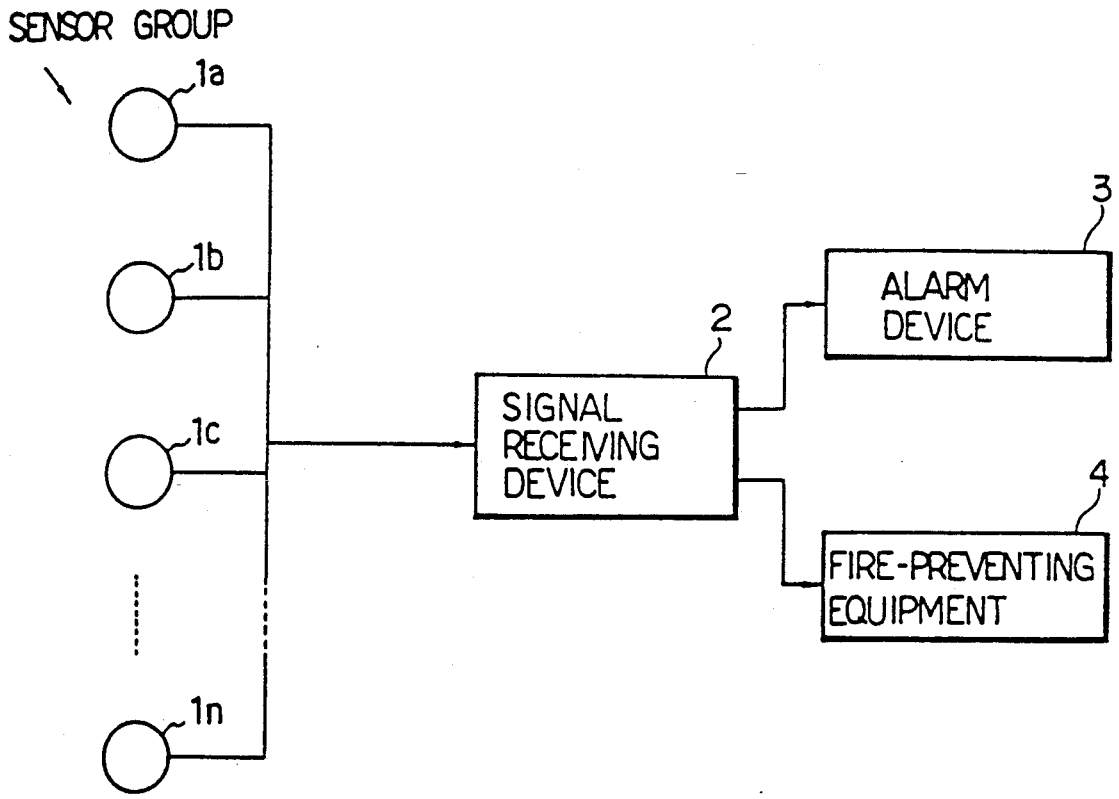
PRIOR ART Fig. 12
FIG. 12 is a view illustrating the structure of a fire determining system to which the conventional method of determining fires is applied.

FIG. 11 shows the structure of a fire determining system according to a fourth embodiment of this invention. In the fourth embodiment, a first sensor 5*a*, a second sensor 6*a*, a receiving device 21, and a determining device 22 are all incorporated into one sensor. The results of determining whether a fire has broken out are transmitted to a signal processor 11 via a transmission interface 23 and another transmission interface 10. The interface 23 is disposed at the base of each sensor, into which the first sensor 5*a*, the second sensor 6*a*, the receiving device 21 and the determining device 22 are incorporated. All signals from the fire determining system are transferred to the signal processor 11 through the interface 10. The signal processor 11 is disposed at a receiving device in a certain location, such as a central monitoring room. A control device 12 controls an alarm device 13 and other devices on the basis of signals from the signal processor 11.

What is claimed is:

1. A combined method for determining presence of fires from a fire source with a heat release value and producing an amount of product due to burning, said method comprising the steps of:

providing a plurality of fire sensors for detecting different objects;

transmitting output signals from said fire sensors to a signal processor at a predetermined central monitoring room location;

processing signals from said signal processor by means for determining outbreak of fires and emitting thereupon an alarm;

arranging at least a pair of a first one of said fire sensors and a second one of said fire sensors in a zone to be monitored;

measuring with said first sensor physical quantities correlated with said heat release value of said fire source;

measuring with said second sensor physical quantities correlated with said amount of product due to burning;

setting said first sensor with a first threshold of high sensitivity and a second threshold of low sensitivity;

setting said second sensor with a third threshold;

emitting a pre-alarm only when a signal level from said second sensor exceeds said third threshold and changing the threshold of said first sensor to said first threshold of high sensitivity;

emitting a fire alarm and keeping the threshold of said first sensor high when a signal level from said second sensor exceeds said first threshold; and emitting a fire alarm when a signal level from said first sensor exceeds said second threshold of low sensitivity even if a signal level from said second sensor is less than said third threshold.

2. A combined method according to claim 1, wherein the fire alarm is emitted when there is a hysteresis with the signal level form the second sensor having once exceeded the third threshold and when the signal level from the first sensor exceeds the first threshold.

3. A combined method according to claim 1, wherein said first sensor is a heat characteristic sensor and said second sensor is a smoke sensor.

4. A combined method according to claim 3, wherein said heat characteristic sensor is a fixed temperature heat detector.

5. A method according to claim 3, wherein said heat characteristic sensor is a rate of rise heat detector.

6. A combined method according to claim 1, wherein said first sensor has an infrared detector for detecting the radiant intensity of the fire source, a detector for detecting oxygen concentration and a detector for detecting carbon dioxide, said second sensor having a detector for detecting steam density, a detector for detecting the concentration of a hydrocarbon compound, a detector for detecting the concentration of hydrogen sulfide and a detector for detecting hydrogen cyanide.

7. A combined method according to claim 1, wherein when the signal level from the second sensor continuously exceeds the third threshold for more than a predetermined amount of time, smoke controlling equipment with a smoke vent and a fire door, is started controllably.

8. A combined method according to claim 1, wherein the pre-alarm is emitted so that an instruction for confirming that a fire has occurred is transmitted to monitoring personnel for a building and so that a broadcast for attracting attention of people is made in the building, and the first alarm is transmitted to people in the building by sounding bells so that the fire alarm is automatically reported to a fire station.

9. A combined method according to claim 1, wherein said receiving means, said means for determining outbreak of fires, and a transmission interface are provided for each pair of said first sensor and said second sensor in a zone to be monitored, and transferring the results of said means for determining outbreak of fires, to said signal processor.

10. A combined method according to claim 1, wherein said first sensor, said second sensor, said receiving means, and said means for determining outbreak of fires are built into one sensor, and transferring the results of determination performed by said means for determining outbreak of fires to said signal processor through a transmission interface provided in a base for mounting the sensor.

11. A combined method for determining presence of fires from a fire source with a heat release value and producing an amount of product due to burning, said method comprising the steps of:

providing a plurality of fire sensors for detecting different objects;

transmitting output signals from said fire sensors to a signal processor at a predetermined central monitoring room location;

processing signals from said signal processor by means for determining outbreak of fires and emitting thereupon an alarm;

arranging at least a pair of a first one of said fire sensors and a second one of said fire sensors in a zone to be monitored;

measuring with said first sensor physical quantities correlated with said heat release value of said fire source;

measuring with said second sensor physical quantities correlated with said amount of product due to burning;

setting said first sensor with a first threshold of high sensitivity and a second threshold of low sensitivity;

setting said second sensor with a third threshold;

emitting a pre-alarm only when a signal level from said second sensor exceeds said third threshold and changing the threshold of said first sensor to said first threshold of high sensitivity;

emitting a fire alarm and keeping the threshold of said first sensor high when a signal level from said second sensor exceeds said first threshold; and emitting a fire alarm when a signal level from said first sensor exceeds said second threshold of low sensitivity even if a signal level from said second sensor is less than said third threshold; said fire alarm being emitted when there is a hysteresis with the signal level from the second sensor having once exceeded the third threshold and when the signal level from the first sensor exceeds the first threshold; said pre-alarm being emitted so that an instruction for confirming that a fire has occurred is transmitted to monitoring personnel for a building and so that a broadcast for attracting attention of people is made in the building, and the fire alarm being transmitted to people in the building by sounding bells so that the fire alarm is automatically reported to a fire station.

* * * * *